US007668486B2

(12) United States Patent
Kadota et al.

(10) Patent No.: US 7,668,486 B2
(45) Date of Patent: Feb. 23, 2010

(54) ROTATION SPEED CONTROL DEVICE AND IMAGE FORMING DEVICE

(75) Inventors: Masaki Kadota, Osaka (JP); Takahiko Murata, Osaka (JP); Minoru Wada, Osaka (JP); Tetsuro Kawashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 571 days.

(21) Appl. No.: 11/715,362

(22) Filed: Mar. 8, 2007

(65) Prior Publication Data

US 2007/0212112 A1 Sep. 13, 2007

(30) Foreign Application Priority Data

Mar. 9, 2006 (JP) ..... 2006-064296

(51) Int. Cl.
*G03G 15/01* (2006.01)

(52) U.S. Cl. ..... 399/227; 399/53; 399/222; 399/226; 399/228

(58) Field of Classification Search ..... 399/53, 399/222, 226, 227, 228
See application file for complete search history.

(56) References Cited

U.S. PATENT DOCUMENTS 5,294,967 A * 3/1994 Munakata et al. ..... 399/227
6,240,268 B1 * 5/2001 Nishiuwatoko ..... 399/222
7,068,956 B2 * 6/2006 Tsukida et al. ..... 399/227
2004/0057751 A1 * 3/2004 Matsuo et al. ..... 399/227
2004/0213601 A1 * 10/2004 Ikeda et al. ..... 399/227
2006/0039720 A1 * 2/2006 Miyazawa et al. ..... 399/227

FOREIGN PATENT DOCUMENTS

JP 11-174826 A 7/1999
JP 2006201229 A * 8/2006

OTHER PUBLICATIONS

English Abstract of JP 2006201229 to Yamazaka et al.*

* cited by examiner

*Primary Examiner*—David M Gray
*Assistant Examiner*—Ryan D Walsh
(74) *Attorney, Agent, or Firm*—Frommer Lawrence & Haug LLP

(57) ABSTRACT

The image forming unit 100 includes a photosensitive drum 11, a rotary developing device 30, and a rotation speed control device 70. Electrostatic latent images are formed on the surface of the photosensitive drum 11. The rotary developing device 30 includes a plurality of developing apparatuses 13 having a developing roller 14 disposed in opposition to the photosensitive drum 11, and a distance regulating collar 73 that regulates the distance between the photosensitive drum 11 and the developing roller 14. The rotation speed control device 70 includes a rotation speed control device 71 that controls the rotation speed of the rotary developing device 30 so that for a predetermined period of time until the developing apparatus 13 reaches the developing position the rotation speed of the photosensitive drum 11 and the movement speed in the circumferential direction of the distance regulating collar 73 are equal.

15 Claims, 7 Drawing Sheets

ROTATION SPEED CONTROL DEVICE AND IMAGE FORMING DEVICE

CROSS-REFERENCE TO RELATED APPLICATIONS

This application claims priority to Japanese Patent Application No. 2006-064296 filed on Mar. 9, 2006. The entire disclosure of Japanese Patent Application No. 2006-064296 is hereby incorporated herein by reference.

BACKGROUND OF THE INVENTION

1. Field of the Invention

The present invention generally relates to an image forming unit and image forming device. More specifically, the present invention relates to an image forming unit that includes a rotation speed control device that controls the rotation speed of a rotary developing device and an image forming device that includes such an image forming unit.

2. Background Information

Image forming devices that form color images include a plurality of developing apparatuses that each house toner of a different color. Some image forming devices that form color images have rotary developing devices in which the plurality of developing apparatus is fitted around a rotatable frame. In an image forming device that uses a rotary developing device, the frame is rotated and the developing apparatus that houses the developer with the first color is brought into opposition with an electrostatic latent image carrier, and the developer in the developing apparatus is supplied to the electrostatic latent image carrier. After the developer for the first color has been supplied to the electrostatic latent image carrier, the frame is rotated and the developing apparatus that houses the developer with the second color is brought into opposition with the electrostatic latent image carrier, and the developer in the developing apparatus is supplied to the electrostatic latent image carrier. In this way, developer is supplied to the electrostatic latent image carrier in turn so that developer for all the colors is supplied to the electrostatic latent image carrier.

Here, when supplying developer from the developing apparatus to the electrostatic latent image carrier, there is a system in which the developer on a developing roller is supplied to the electrostatic latent image carrier without the developing roller contacting the electrostatic latent image carrier. In image forming devices that adopt this system, a distance regulating collar whose diameter is slightly larger than the diameter of the developing roller is provided at both ends of the developing roller in the axial direction. The distance regulating collars contact the electrostatic latent image carrier so a gap is maintained between the developing roller and the electrostatic latent image carrier as shown in Japanese Patent Application Laid-open No. H11-174826.

In the image forming device described in the aforementioned patent document, to prevent the distance regulating collars from applying shocks to the surface of the electrostatic latent image carrier as a result of the electrostatic latent image carrier and the distance regulating collars contacting at different movement speeds in the circumferential direction, the movement speed in the circumferential direction of the distance regulating collars is reduced before the electrostatic latent image carrier and the distance regulating collars contact. Then contact is made at the instant that the movement speed in the circumferential direction of the electrostatic latent image carrier and the distance regulating collars is the same.

However, in the image forming device described in the patent document, the phase speed in the circumferential direction of the distance regulating collars is reduced continuously so the movement speed in the circumferential direction of the electrostatic latent image carrier and the distance regulating collars is the same only for an instant. Therefore, if even a small error occurs the movement speed in the circumferential direction of the electrostatic latent image carrier and the distance regulating collars will be different, and a shock will be applied to the electrostatic latent image carrier by the distance regulating collars. When a shock is applied to the electrostatic latent image carrier in this way, the photosensitive layer of the electrostatic latent image carrier can peel off, and the electrostatic latent image carrier can become deformed. Therefore, a constant distance between the developing roller and the electrostatic latent image carrier cannot be maintained, and image quality can be reduced by unevenness in the image and so on.

In view of the above, it will be apparent to those skilled in the art from this disclosure that there exists a need for an improved image forming device. This invention addresses this need in the art as well as other needs, which will become apparent to those skilled in the art from this disclosure.

SUMMARY OF THE INVENTION

It is an object of the present invention to prevent reduction in image quality as a result of the movement speed of the electrostatic latent image carrier and the distance regulating collars in the circumferential direction differing when the electrostatic latent image carrier and the distance regulating collars contact.

An image forming unit according to a first aspect of the present invention includes a photosensitive drum, a rotary developing device, and a rotation speed control device. Electrostatic latent images are formed on the surface of the photosensitive drum. The rotary developing device includes a plurality of developing apparatuses having a developing roller disposed in opposition to the photosensitive drum, and a distance regulating collar that regulates the distance between the photosensitive drum and the developing roller. The rotation speed control device includes a rotation speed control device that controls the rotation speed of the rotary developing device so that for a predetermined period of time until the developing apparatus reaches the developing position the rotation speed of the photosensitive drum and the movement speed in the circumferential direction of the distance regulating collar are equal.

An image forming unit according to a second aspect of the present invention is the image forming unit according to a first aspect, wherein the rotation speed control device controls the rotation of the rotary developing device so that the rotation speed is faster than the rotation speed of the electrostatic latent image carrier, then decelerates the distance regulating collar so that the movement speed in the circumferential direction is the same as the speed of rotation of the electrostatic latent image carrier.

An image forming unit according to a third aspect of the present invention is the image forming unit according to the first aspect, wherein the rotation speed control device controls the rotation speed of the rotary developing device so that for the predetermined period of time that includes the time that the distance regulating collar contacts the electrostatic latent image carrier the rotation speed of the electrostatic latent image carrier and the movement speed in the circumferential direction of the distance regulating collar are equal.

An image forming unit according to a fourth aspect of the present invention is the image forming unit according to the second aspect, wherein the rotation speed control device controls the rotation speed of the rotary developing device so that for the predetermined period of time that includes the time that the distance regulating collar contacts the electrostatic latent image carrier, the rotation speed of the electrostatic latent image carrier and the movement speed in the circumferential direction of the distance regulating collar are equal.

An image forming unit according to a fifth aspect of the present invention is the image forming unit according to the first aspect, wherein the rotation speed control device further includes a rotation stop device that stops the rotation of the rotary developing device.

An image forming unit according to a sixth aspect of the present invention is the image forming unit according to the second aspect, wherein the rotation speed control device further includes a rotation stop device that stops the rotation of the rotary developing device.

An image forming unit according to a seventh aspect of the present invention is the image forming unit according to the third aspect, wherein the rotation speed control device further includes a rotation stop device that stops the rotation of the rotary developing device.

An image forming unit according to an eighth aspect of the present invention is the image forming unit according to the fourth aspect, wherein the rotation speed control device further includes a rotation stop device that stops the rotation of the rotary developing device.

An image forming device according to a ninth aspect of the present invention includes an electrostatic latent image carrier, a rotary developing device, a drive mechanism, a rotation speed control device, and a position determining mechanism. Electrostatic latent images are formed on the surface of the electrostatic latent image carrier. The rotary developing device includes a plurality of developing apparatuses having a developing roller disposed in opposition to the photosensitive drum and a distance regulating collar that regulates the distance between the photosensitive drum and the developing roller. The drive mechanism is a mechanism that drives the rotary developing device so that the developing apparatus of the rotary developing device is brought into opposition with the electrostatic latent image carrier. The rotation speed control device includes a rotation speed control device that controls the rotation speed of the rotary developing device so that for a predetermined period of time until the developing apparatus reaches the developing position the rotation speed of the photosensitive drum and the movement speed in the circumferential direction of the distance regulating collar are equal. The position determining mechanism accurately determines the stop position of the rotary developing device, and includes a gear that rotates the rotary developing device, a cam installed on the gear, a latching member that latches with the cam, and a solenoid that moves the latching member so that the latching member latches with the cam.

An image forming device according to a tenth aspect of the present invention is the image forming device according to the ninth aspect, wherein the rotation speed control device controls the rotation of the rotary developing device so that the rotation speed is faster than the rotation speed of the electrostatic latent image carrier, then decelerates the distance regulating collar so that the movement speed in the circumferential direction is the same as the speed of rotation of the electrostatic latent image carrier.

An image forming device according to an eleventh aspect of the present invention is the image forming device according to the ninth aspect, wherein the rotation speed control device controls the rotation speed of the rotary developing device so that for the predetermined period of time that includes the time that the distance regulating collar contacts the electrostatic latent image carrier the rotation speed of the electrostatic latent image carrier and the movement speed in the circumferential direction of the distance regulating collar are equal.

An image forming device according to a twelfth aspect of the present invention is the image forming device according to the ninth aspect, wherein the rotation speed control device further includes a rotation stop device that stops the rotation of the rotary developing device.

An image forming device according to a thirteenth aspect of the present invention is the image forming device according to the tenth aspect, wherein the rotation speed control device further includes a rotation stop device that stops the rotation of the rotary developing device.

An image forming device according to a fourteenth aspect of the present invention is the image forming device according to the eleventh aspect, wherein the rotation speed control device further includes a rotation stop device that stops the rotation of the rotary developing device.

EFFECTS OF THE INVENTION

The present invention can prevent reduction in image quality as a result of the movement speed in the circumferential direction of the electrostatic latent image carrier and the distance regulating collars differing when they contact.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Configuration

Figure 1:
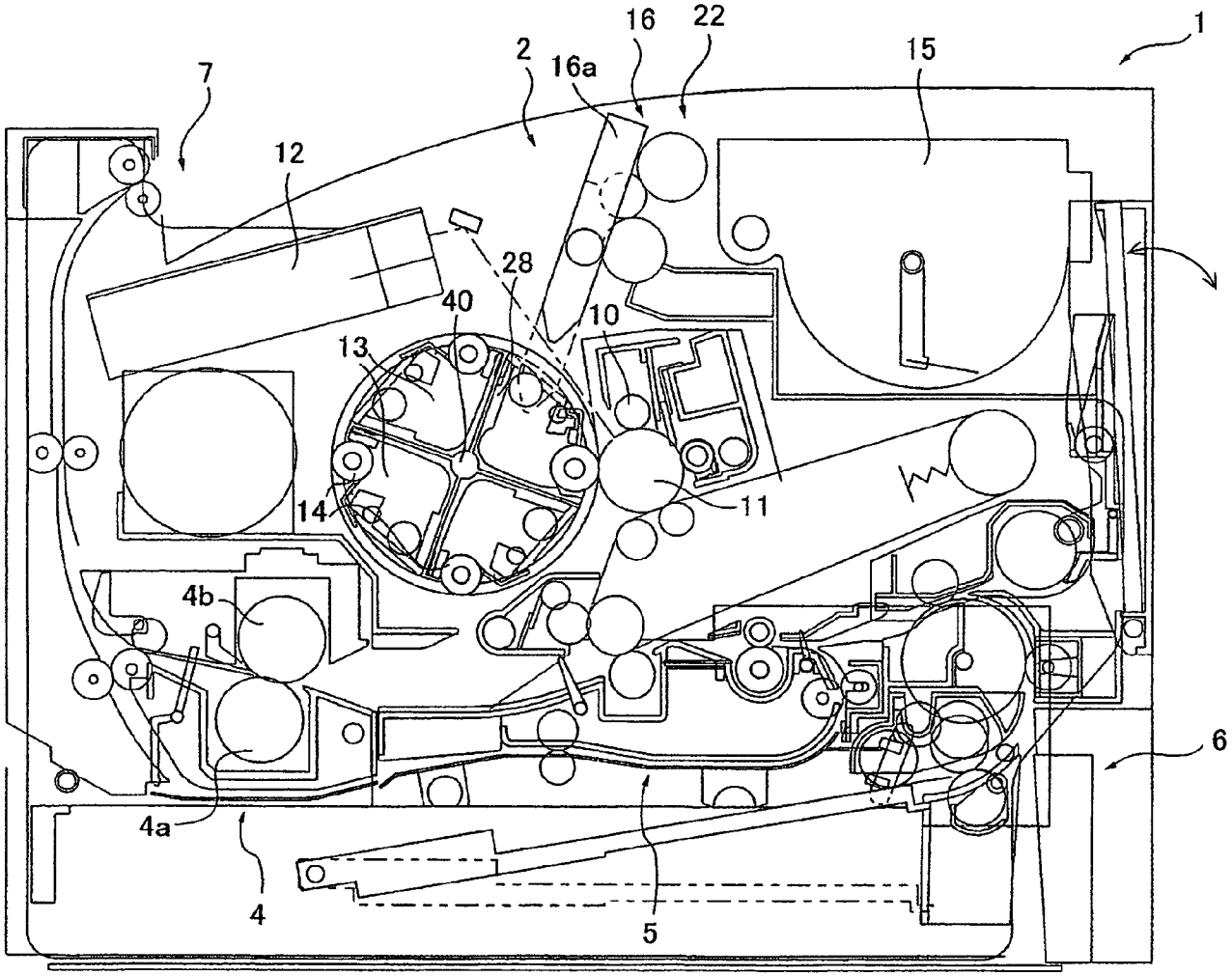
FIG. 1 is a schematic cross-sectional diagrammatical view of an entire color printer in accordance with a first preferred aspect of the present invention.

FIG. 1 shows a color printer 1 that is an image forming device according to a preferred embodiment of the present invention. FIG. 1 shows the disposition of each constitutive element.

The color printer 1 is a device that is connected to a computer or the like, which is not shown in the drawings, and that is capable of printing color images on sheets based on image information transmitted from the computer or the like.

The color printer 1 includes an image forming unit 2, a fixing unit 4, a sheet transport unit 5, a sheet supply unit 6, a discharge unit 7, and a toner replenishment unit 22. The image forming unit 2 forms toner images based on image information. The fixing unit 4 fixes toner images formed in the image forming unit 2 onto sheets. The sheet transport unit 5 transports sheets to the image forming unit 2 and the fixing unit 4. The sheet supply unit 6 supplies sheets to the sheet transport unit 5. The discharge unit 7 discharges sheets on which toner images have been fixed. The toner replenishment unit 22 that replenishes the image forming unit 2 with toner.

Figure 2:
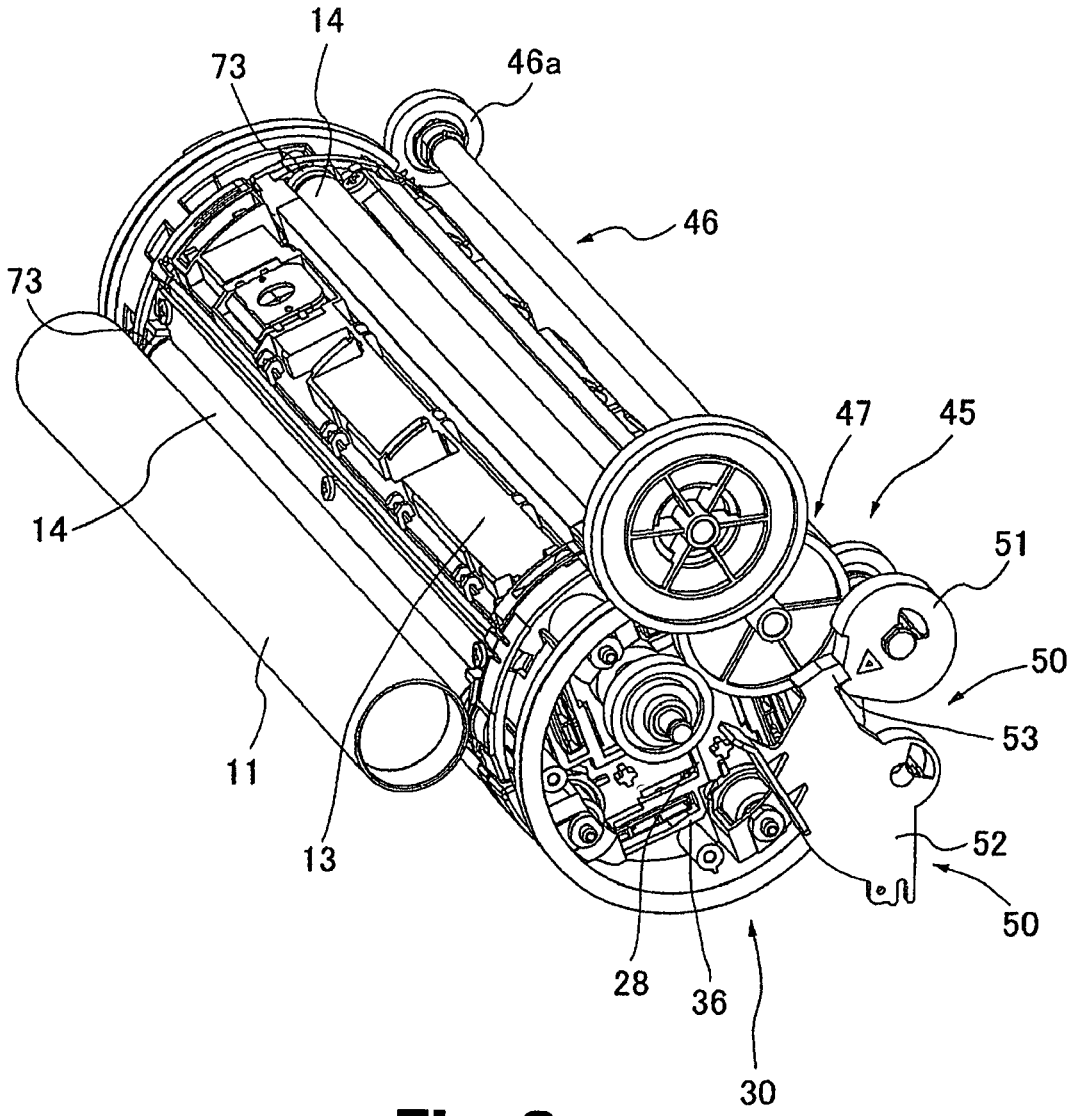
FIG. 2 is a perspective view showing a rotary developing device and a rotary developing device drive mechanism of the color printer.
Figure 3:
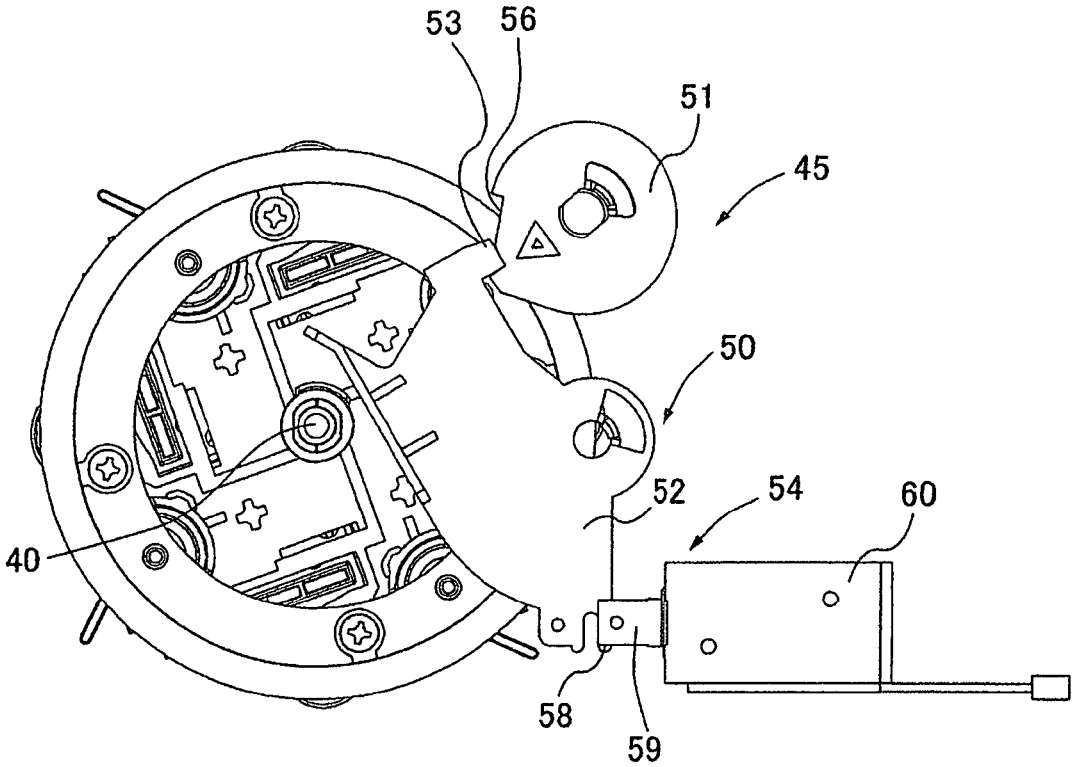
FIG. 3 is a side view showing a position determination mechanism of the color printer.
Figure 4:
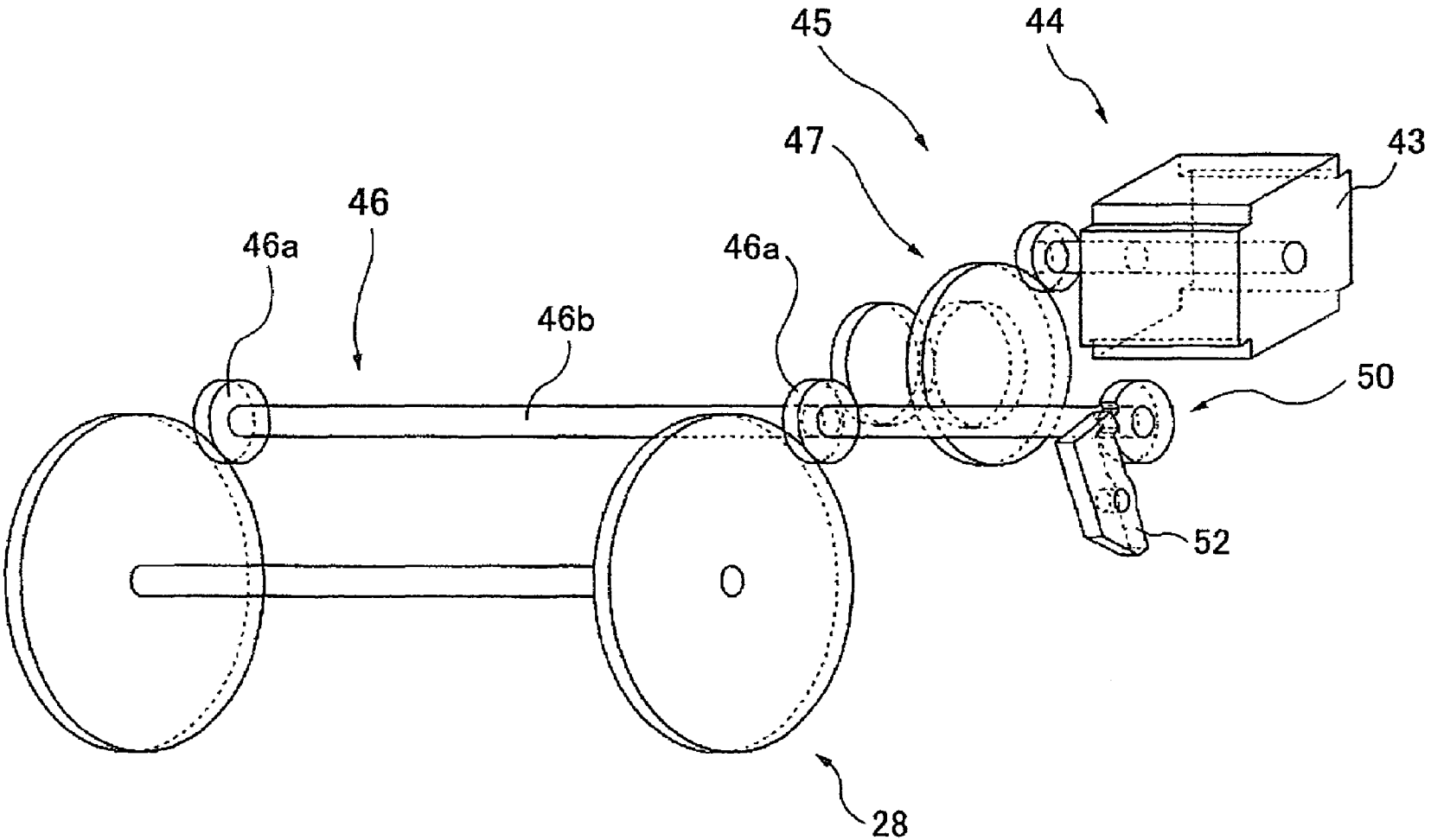
FIG. 4 is a diagrammatical view showing a rotary developing device drive unit of the color printer.
Figure 6:
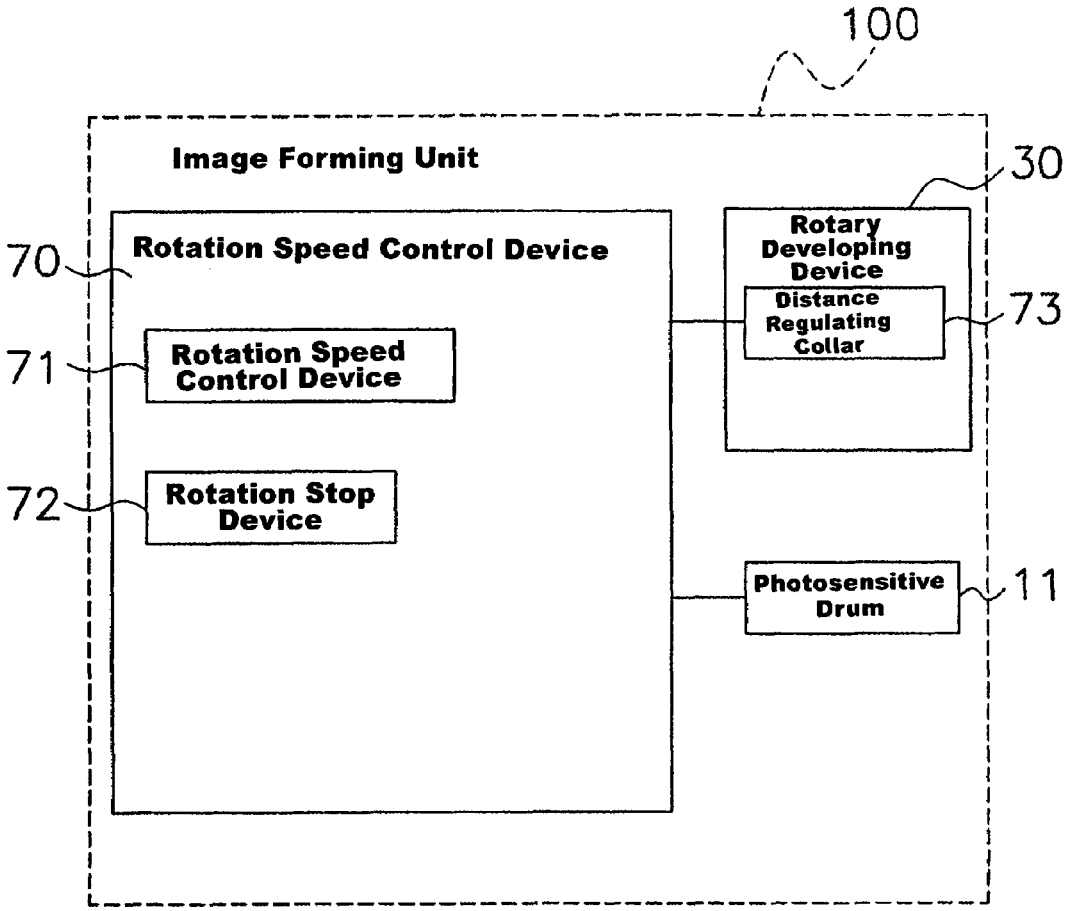
FIG. 6 is a view of a block diagram showing a rotation speed control device.

The image forming unit 2 includes a photosensitive drum 11, a rotary developing device 30, a drive mechanism 45, a position determining mechanism 50, a rotation speed control device 70, and a laser unit 12. Electrostatic latent images and toner images are formed on the surface of the photosensitive drum 11. The rotary developing device 30 that supplies toner to the photosensitive drum 11. As seen in FIGS. 2 through 4, the drive mechanism 45 rotates and stops the rotary developing device 30. The position determining mechanism 50 determines the rotation stop position. As seen in FIG. 6, the rotation speed control device 70 controls the rotation speed of the rotary developing device 30. The laser unit 12 scans and exposes the surface of the photosensitive drum 11 based on image information. Here, the photosensitive drum 11, the rotary developing device 30, and the rotation speed control device 70 form the image forming unit 100 as seen in FIG. 6.

Referring to FIGS. 1 and 2, the photosensitive drum 11 is provided adjacent to the rotary developing device 30, and the rotation axis is provided extending normal to the plane of the paper in FIG. 1. A charging roller 10 is provided to the top of the photosensitive drum 11, and uniformly charges the surface of the photosensitive drum 11.

FIG. 2 shows an isometric view of the rotary developing device 30. As seen in FIGS. 1 and 2, the rotary developing device 30 preferably includes four developing apparatuses 13 that house toner in four colors yellow, cyan, magenta, and black, and a frame 28 that supports the four developing apparatuses 13, and rotates about a rotation shaft 40.

Figure 5:
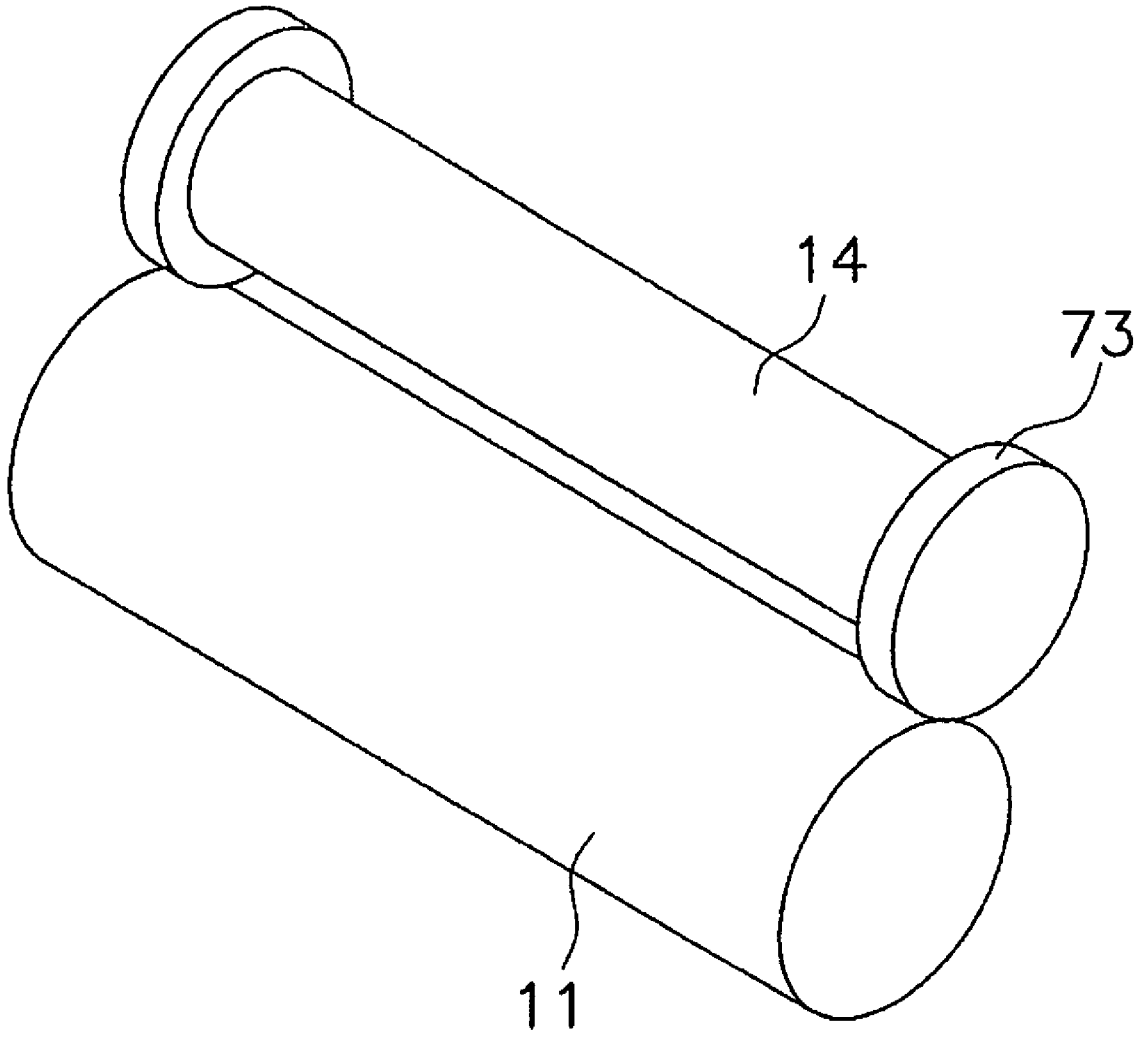
FIG. 5 is a diagrammatical perspective view showing a photosensitive drum and distance regulating collars of the color printer at a developing position.

The four developing apparatuses 13 are the parts that develop the toner images in each of the four colors, and are shaped as a circular cylinder cut into four equal parts in the diametral direction. Also, a developing roller 14 is provided within each developing apparatus 13, and this developing roller 14 supplies toner to the photosensitive drum 11. Further, as shown in FIG. 5, distance regulating collars 73 are disposed at both ends in the axial direction of the developing rollers 14. The distance regulating collars 73 are members that regulate the distance between the photosensitive drum 11 and the developing roller 14 when a developing apparatus 13 is positioned at the developing position. The distance regulating collars 73 are circular plate shaped members, the diameter of whose cross-section is slightly larger than the diameter of the cross-section of the developing rollers 14. Also, the distance regulating collars 73 have the same rotational axis as the rotation axis of the developing rollers 14. The movement speed in the circumferential direction of the distance regulating collars 73 is controlled by the rotation speed control device 70 of the rotary developing device 30. Here, FIG. 5 shows the photosensitive drum 11 in opposition with the developing roller 14, in other words, shows the photosensitive drum 11, the developing roller 14, and the distance regulating collars 73 when the developing apparatus 13 is in the developing position. As stated, the four developing apparatuses 13 are supported by the frame 28.

Referring now to FIGS. 1, 2, and 4, the frame 28 is a member that supports the four developing apparatus 13. The frame 28 includes four flat plates that extend in a radiating pattern from the rotation shaft 40 as center to form four compartments that divide the circumferential direction equally. Also, two circular plates with the same diameter are disposed at each end of the rotation shaft 40 in the axial direction, and gear teeth are formed on the whole perimeter of the outer periphery of these circular plates.

The drive mechanism 45 includes a drive unit 44 that drives the rotary developing device 30. As shown in FIGS. 2 and 4, the drive unit 44 is the part that rotates the rotary developing device 30. The drive unit 44 includes an input gear member 46 that meshes with the gear teeth of the circular plates, a gear train 47 that rotates the input gear member 46, and a motor 43 that is connected to the gear train 47. The input gear member 46 includes a pair of circular plate members **46*a*, and a shaft member 46*b* that connects the pair of circular plate members 46*a*. Gear teeth are formed on the outer periphery of the pair of circular plate members 46*a* that mesh with the gear teeth of the frame 28. The shaft member 46*b* is provided parallel to the rotation shaft 40 of the rotary developing device 30. The gear train 47 transmits the motive power of the motor 43 to the input gear member 46, and includes a plurality of gears. The motor 43 generates the motive power that rotates the rotary developing device 30, and is connected to the gear train 47**.

As shown in FIGS. 2 and 3, the position determining mechanism 50 includes an input cam 51 connected to the input gear member 46 (the gear that rotates the rotary developing device 30), a latching member 52 having a projection 53 that latches with the input cam 51, and a solenoid 54 that drives the latching member 52. The input cam 51 is installed on the shaft member **46*b* of the input gear member 46 shown in FIG. 4, disposed to the outside of one of the circular plate members 46*a*. Also, the input cam 51 is a circular plate shaped member having a first latching portion 56 that latches with the projection 53 of the latching member 52. When the first latching portion 56 is latched with the projection 53, the developing apparatus 13 of one of the colors and the photosensitive drum 11 are in opposition, in other words, the developing apparatus 13 is in the developing position. The latching member 52 is a flat plate shaped member that has the projection 53 that latches with the first latching portion 56 of the input cam 51 and a connecting portion 58 that is connected to the solenoid 54. The latching member 52 is supported on the external frame of the color printer 1. Also, the projection 53 is forced against the input cam 51 by an elastic member that is not shown in the drawings. As best seen in FIG. 3, the solenoid 54 includes a main body portion 60 and a projection portion 59 that projects from the main body portion 60, and is fixed to the external frame of the color printer 1. When developing is finished by each developing apparatus 13 that contains developer in one of the respective colors, the electrical power is turned on to the solenoid 54 and the projection portion 59 is retracted into the main body portion 60. By retracting the projection portion 59 into the main body portion 60 of the solenoid 54 the latch between the latching member 52 and the input cam 51** is released.

As shown in FIG. 6, the rotation speed control device 70 functions as rotation speed control device 71 and rotation stop device 72, and is specifically realized by a computer or the like. Referring to FIGS. 1, 2, and 6, the rotation speed control device 71 controls the rotation speed of the rotary developing device 30 so that before the rotary developing device 30 is positioned in the developing position the rotation speed of the photosensitive drum 11 and the movement speed in the circumferential direction of the distance regulating collars 73 are equal for a fixed period of time. The rotation stop device stops the rotation of the rotary developing device 30. The rotation speed control device 70 controls the rotation speed of the rotary developing device 30 as follows. The rotation speed of the rotary developing device 30 is controlled and the speed of movement in the circumferential direction of the distance regulating collars 73 is increased until the developing apparatus 13 is in the developing position. Then, after maintaining the rotation speed of the rotary developing device 30 at a high speed for a fixed period of time, when the developing apparatus 13 is a predetermined distance from the developing position the rotation speed of the rotary developing device is reduced, in other words the speed of movement in the circumferential direction of the distance regulating collars 73 is reduced. Then, when the speed of movement in the circumferential direction of the distance regulating collars 73 is the same as the speed of movement in the circumferential direction of the photosensitive drum 11, the reduction of the speed of the rotary developing device 30 is stopped, and the reduction in speed of movement in the circumferential direction of the distance regulating collars 73 is stopped. In other words, for a fixed period of time the rotation speed of the distance regulating collars 73 and the photosensitive drum 11 is the same. In this way, when the speed of movement in the circumferential direction of the photosensitive drum 11 and the speed of movement in the circumferential direction of the distance regulating collars 73 are the same speed, the developing apparatus 13 is moved into a position in opposition to the photosensitive drum 11, in other words a position in which the distance regulating collars 73 and the photosensitive drum 11 are in contact.

The laser unit 12 irradiates the photosensitive drum 11 with laser light, and is disposed higher than the photosensitive drum 11 and in the opposite direction to the direction that would sandwich the photosensitive drum 11 between the four developing apparatus 13 and the laser unit 12.

The fixing unit 4 fixes images formed in the image forming unit 2 onto sheets, and includes a pressure roller 4*a* and a heating roller 4*b*.

The sheet transport unit 5 transports sheets to the image forming unit 2 and the fixing unit 4, and extends from the sheet supply unit 6 to the discharge unit 7.

The sheet supply unit 6 supplies sheets to the sheet transport unit 5 to print, and includes a sheet supply cassette and a roller to supply sheets to the sheet transport unit 5 and so on. Also, the sheet supply unit 6 is disposed to the lower side of the color printer 1.

The discharge unit 7 discharges sheets on which images have been fixed via the sheet transport unit 5, and is disposed on the top surface of the color printer 1.

The toner replenishment unit 22 replenishes the developing apparatus 13 with toner, and includes a toner housing unit 15 that houses toner to replenish, and a toner replenishing device 16 that replenishes the developing apparatus 13 with toner from the toner housing unit 15. The toner housing unit 15 includes four box shaped containers that each house toner in one of the colors. The toner replenishment device 16 has a toner supply pipe 16*a*. When replenishing with toner, the toner supply pipe 16*a* is moved, and the developing apparatus 13 is replenished with toner.

Operation

The following is an explanation of the operation when printing a color image by the color printer 1 with reference to the figures. Information on the image to be formed is transmitted from a computer or similar connected to the outside of the color printer 1. An electrostatic latent image is formed on the photosensitive drum 11 based on the image information. Toner from the developing apparatus 13 is supplied to the electrostatic latent image on the photosensitive drum 11 to form a toner image.

Specifically, power is supplied from the motor 43 via the gear train 47 to rotate the rotary developing device 30, and the developing roller 14 of the developing apparatus 13 is brought into opposition with the photosensitive drum 11. At this time the rotation speed of the rotary developing device 30 is controlled and the speed of movement in the circumferential direction of the distance regulating collars 73 is increased until the developing apparatus 13 is in the developing position. Then, after maintaining the rotation speed of the rotary developing device 30 at a high speed for a fixed period of time, when the developing apparatus 13 is a predetermined distance from the developing position the rotation speed of the rotary developing device is reduced, in other words the speed of movement in the circumferential direction of the distance regulating collars 73 is reduced. Then, when the speed of movement in the circumferential direction of the distance regulating collars 73 is the same as the speed of movement in the circumferential direction of the photosensitive drum 11, the reduction of the speed of the rotary developing device 30 is stopped, and the reduction in speed of movement in the circumferential direction of the distance regulating collars 73 is stopped. In other words, for a fixed period of time the rotation speed of the distance regulating collars 73 and the photosensitive drum 11 is the same. In this way, when the speed of movement in the circumferential direction of the photosensitive drum 11 and the speed of movement in the circumferential direction of the distance regulating collars 73 are the same speed, the developing apparatus 13 is moved into a position in opposition to the photosensitive drum 11, in other words a position in which the distance regulating collars 73 and the photosensitive drum 11 are in contact. When the developing apparatus 13 is in the developing position, rotation is completely stopped by the position determining mechanism 50. In detail, electrical power is turned off to the solenoid 54 and the projection portion 59 projects, and the input cam 51 and the latching member 52 are latched. When the input cam 51 and the latching member 52 are latched, rotation of the rotary developing device 30 is stopped.

In this state, there is a gap of a fixed size between the photosensitive drum 11 and the developing roller 14. In this state a voltage having a direct current voltage component to which an alternating current voltage has been added is applied to the photosensitive drum 11 and the developing roller 14. The toner on the developing roller 14 to which the voltage has been applied is transferred onto the photosensitive drum 11. After toner in the first color has been supplied from the developing apparatus 13 in this way, the rotary developing device 30 is driven by the drive mechanism 45, and toner in the second and subsequent colors is provided. Here, after the movement speed in the circumferential direction of the distance regulating collars 73 and movement speed in the circumferential direction of the photosensitive drum 11 become equal, the photosensitive drum 11 and the distance regulating collars 73 contact. Therefore it is possible to reduce shocks received by the photosensitive drum 11 from the distance regulating collar 73, and reduction in image quality can be prevented.

Figure 7:
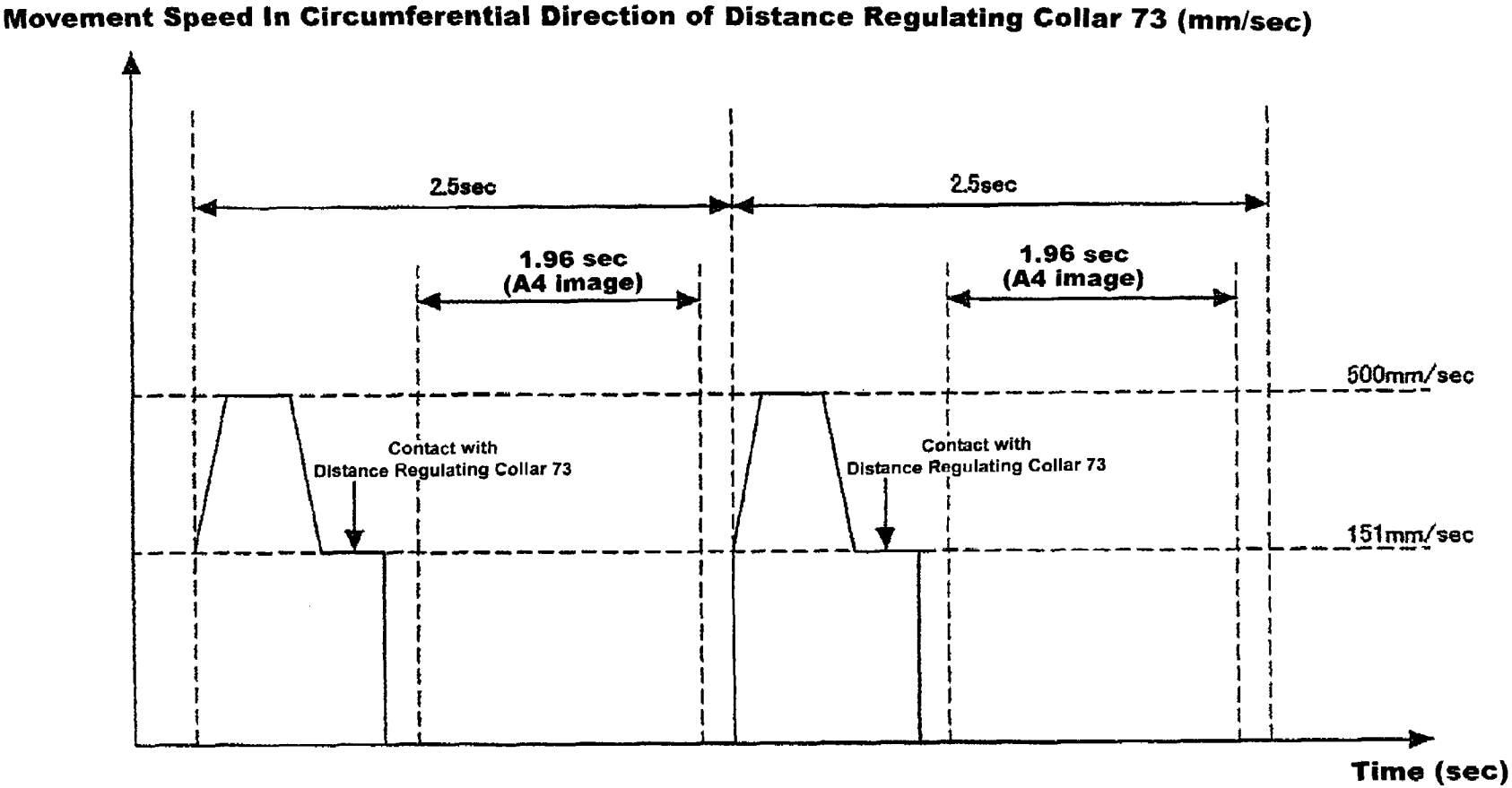
FIG. 7 is a view of a diagram showing movement speed in the circumferential direction of the distance regulating collars.

Also, FIG. 7 shows the rotation speed control of a specific rotary developing device 30. The speed in the circumferential direction of the distance regulating collars 73 is increased until the distance regulating collars 73 contact the photosensitive drum 11. In other words, the rotation speed of the rotary developing device 30 is increased until the rotation speed reaches 500 mm/second. Then the rotary developing device 30 is rotated at the rotation speed 500 mm/sec. for a fixed period of time. After the predetermined period of time has passed, the rotation speed of the rotary developing device 30 is reduced. When the rotation speed of the photosensitive drum 11 and the movement speed in the circumferential direction of the distance regulating collars 73 both become the same 151 mm/sec., the rotary developing device 30 is rotated at 151 mm/sec. for a predetermined period of time (a period of time that includes the instant of contact between the photosensitive drum 11 and the distance regulating collars 73). Then rotation of the rotary developing device 30 is stopped. At this time, in 1.96 seconds an A4 size image in the color of the toner disposed within the developing apparatus 13 in opposition to the photosensitive drum 11 is developed. In this color printer 1, developing one color requires 2.5 seconds. When forming the next image the same speed control is carried out again. The description provided here is an example, and the present invention is not limited to this, and other speeds and so on may be used.

After the toner image has been formed on the photosensitive drum 11, the toner image formed on the photosensitive drum 11 is transferred to a sheet. The sheet onto which the toner image is transferred is transported to the fixing unit 4 by the sheet transport unit 5, and the toner image is fixed onto the sheet in the fixing unit 4. The sheet onto which the toner image is fixed is discharged by the discharge unit 7. In this way, the image is printed onto the sheet based on the image information.

Other Embodiments

The embodiment described above used a color printer, but the present invention is not limited to this, and a photocopier, multi-purpose printer, or another image forming device may be used.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including," "having" and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming device according to the present invention. Accordingly, these terms, as utilized to describe the present invention should be interpreted relative to an image forming device equipped with the present invention as used in the normal riding position. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming unit, comprising:

an electrostatic latent image carrier having a surface being configured to have electrostatic latent images formed thereon;

a rotary developing device having a plurality of developing apparatuses each having a developing roller disposed in opposition to the electrostatic latent image carrier, and a distance regulating collar being configured to regulate a distance between the electrostatic latent image carrier and the developing roller;

a rotation speed control device being configured to control rotation speed of the rotary developing device so that for a predetermined period of time until the developing apparatus is in the developing position the rotation speed of the electrostatic latent image carrier and movement speed in the circumferential direction of the distance regulating collar are equal.

2. The image forming unit according to claim 1, wherein the rotation speed control device controls the rotation of the rotary developing device so that the rotation speed is faster than the rotation speed of the electrostatic latent image carrier, then decelerates the distance regulating collar so that the movement speed in the circumferential direction is the same as the speed of rotation of the electrostatic latent image carrier.

3. The image forming unit according to claim 1, wherein the rotation speed control device controls the rotation speed of the rotary developing device so that for the predetermined period of time that includes the time that the distance regulating collar contacts the electrostatic latent image carrier, the rotation speed of the electrostatic latent image carrier and the movement speed in the circumferential direction of the distance regulating collar are equal.

4. The image forming unit according to claim 2, wherein the rotation speed control device controls the rotation speed of the rotary developing device so that for the predetermined period of time that includes the time that the distance regulating collar contacts the electrostatic latent image carrier the rotation speed of the electrostatic latent image carrier and the movement speed in the circumferential direction of the distance regulating collar are equal.

5. The image forming unit according to claim 1, wherein the rotation speed control device further includes a rotation stop device that stops the rotation of the rotary developing device.

6. The image forming unit according to claim 2, wherein the rotation speed control device further includes a rotation stop device that stops the rotation of the rotary developing device.

7. The image forming unit according to claim 3, wherein the rotation speed control device further includes a rotation stop device that stops the rotation of the rotary developing device.

8. The image forming unit according to claim 4, wherein the rotation speed control device further includes a rotation stop device that stops the rotation of the rotary developing device.

9. An image forming device, comprising:

an electrostatic latent image carrier having a surface being configured to have electrostatic latent images formed thereon;

a rotary developing device having a plurality of developing apparatuses each having a developing roller disposed in opposition to the electrostatic latent image carrier, and a distance regulating collar being configured to regulate distance between the electrostatic latent image carrier and the developing roller;

a drive mechanism being configured to drive the rotary developing device to bring the developing apparatus of the rotary developing device into opposition with the electrostatic latent image carrier;

a rotation speed control device being configured to control the rotation speed of the rotary developing device so that for a predetermined period of time until the developing apparatus is in the developing position the rotation speed of the electrostatic latent image carrier and the movement speed in the circumferential direction of the distance regulating collar are equal; and a position determining mechanism being configured to determine the stop position of the rotary developing device, the position determining mechanism having a gear being configured to rotate the rotary developing device, a cam being installed on the gear, a latching member being configured to latch with the cam, and a solenoid being configured to move the latching member to latch and to unlatch the latching member latches with the cam.

10. The image forming device according to claim 9, wherein the rotation speed control device controls the rotation of the rotary developing device so that the rotation speed is faster than the rotation speed of the electrostatic latent image carrier, then decelerates the distance regulating collar so that the movement speed in the circumferential direction is the same as the speed of rotation of the electrostatic latent image carrier.

11. The image forming device according to claim 9, wherein the rotation speed control device controls the rotation speed of the rotary developing device so that for the predetermined period of time that includes the time that the distance regulating collar contacts the electrostatic latent image carrier, the rotation speed of the electrostatic latent image carrier and the movement speed in the circumferential direction of the distance regulating collar are equal.

12. The image forming device according to claim 9, wherein the rotation speed control device further includes a rotation stop device that stops the rotation of the rotary developing device.

13. The image forming device according to claim 10, wherein the rotation speed control device further includes a rotation stop device that stops the rotation of the rotary developing device.

14. The image forming device according to claim 11, wherein the rotation speed control device further includes a rotation stop device that stops the rotation of the rotary developing device.

15. The image forming device according to claim 9, wherein the rotation speed control device increases the rotation speed of the rotary developing device to a predetermined high speed, the high speed being greater than a rotation speed of the electrostatic latent image carrier, maintains the high speed for a fixed period of time until the rotary developing device is a predetermined distance from the developing position, and reduces the rotation speed until the rotary developing device and electrostatic latent image carrier rotate at the same speed.

* * * * *